US005292235A

United States Patent [19]

Eickmann

[11] Patent Number: 5,292,235

[45] Date of Patent: Mar. 8, 1994

[54] MEMBRANES AND NEIGHBORING MEMBERS IN PUMPS, COMPRESSORS AND DEVICES

[76] Inventor: Karl Eickmann, 2420 Isshiki, Hayama-machi, Kanagawa-ken, Japan

[21] Appl. No.: 820,825

[22] Filed: Jan. 15, 1992

Related U.S. Application Data

[63] Continuation-in-part of Ser. No. 481,917, Feb. 20, 1990, abandoned, which is a continuation-in-part of Ser. No. 146,929, Jan. 22, 1988, Pat. No. 4,904,167.

[30] Foreign Application Priority Data

| | | | |
|---|---|---|---|
| Sep. 26, 1986 | [DE] | Fed. Rep. of Germany | 3632717 |
| Sep. 29, 1986 | [DE] | Fed. Rep. of Germany | 3633053 |
| Oct. 17, 1986 | [DE] | Fed. Rep. of Germany | 3635315 |
| Feb. 26, 1987 | [DE] | Fed. Rep. of Germany | 3706188 |

[51] Int. Cl.[5] ..... F04B 43/02

[52] U.S. Cl. ..... 417/383; 417/395

[58] Field of Search ..... 417/383, 385, 386, 387, 417/388, 395, 413

[56] References Cited

U.S. PATENT DOCUMENTS

| | | | |
|---|---|---|---|
| 2,546,302 | 3/1951 | Gehres et al. | 417/383 |
| 2,861,518 | 11/1958 | Pleuger | 417/383 |
| 2,963,976 | 12/1960 | Schaurte | 417/383 |
| 3,664,770 | 5/1972 | Palmer | 417/383 |
| 4,022,381 | 5/1977 | Karliner | 417/388 |
| 4,188,170 | 2/1980 | Ito | 417/388 |
| 4,375,346 | 3/1983 | Kraus et al. | 417/395 |
| 4,621,989 | 11/1986 | Burgert | 417/383 |
| 4,822,255 | 4/1989 | Eickmann | 417/401 |

FOREIGN PATENT DOCUMENTS

| | | |
|---|---|---|
| 0285685 | 12/1988 | European Pat. Off. . |
| 37116339 | 1/1989 | Fed. Rep. of Germany . |
| 63-248979 | 10/1988 | Japan . |

*Primary Examiner*—Richard A. Bertsch
*Assistant Examiner*—Peter Korytnyk

[57] ABSTRACT

In a membrane pump for very high pressure, an axially moveable control member is provided in a body which borders a fluid handling chamber to form a narrow annular clearance around the control member and to form at the axial movement of the control member a cross-sectional area for big flow-through fluid quantities and temporarily a very narrow clearance for the prevention of deflection of portions of the membrane over the flow-through fluid passage.

7 Claims, 2 Drawing Sheets

MEMBRANES AND NEIGHBORING MEMBERS IN PUMPS, COMPRESSORS AND DEVICES

CROSS-REFERENCE TO RELATED APPLICATIONS

This application is a continuation-in-part of U.S. application Ser. No. 07/481,917, filed Feb. 20, 1990, now abandoned, which is a continuation-in-part of U.S. application Ser. No. 07/146,929, filed Jan. 22, 1988, now U.S. Pat. No. 4,904,167.

DESCRIPTION OF THE PRIOR ART

The most advanced and most closely related prior art may present in the inventor's earlier, now published, following patent applications and publications:

Germany: P 37 11 633.9, filed Apr. 7, 1987, published Apr. 20, 1989;

Japan: Sho 62-83.112, filed Apr. 6, 1987, published Oct. 17, 1988 63-248,979.

USA: Ser. No. 07/037,910, filed Apr. 8, 1987, now U.S. Pat. No. 4,822,255, issued Apr. 18, 1989 and:

Europe: 87105 118.1, filed Apr. 7, 1987, published on Dec. 10, 1988 as E-OS 0,285,685.

These applications describe many details and functions of high pressure pumps in excess of one thousand atmospheres. These descriptions apply partially also to the present patent applications and similar members have equal referential numbers as in the mentioned earlier application. The contents of the above mentioned applications in different countries are substantially equal, but appear in different languages.

SUMMARY OF THE INVENTION

The aim and object of the present invention is, to improve especially membrane pumps of the above defined prior art of inventor's devices towards bigger delivery quantity per given outer diameter of the respective membrane, to improve the reliability, efficiency and life time of the membranes and the provision of suitable neighboring parts for prevention of break of membranes by meeting with unsuitable neighboring parts or portions.

These objects and aims of the invention are obtained and secured by the details which appear in the following description of the preferred embodiments of the invention and in the claims.

DESCRIPTION OF THE PREFERRED EMBODIMENTS

Figure 1:
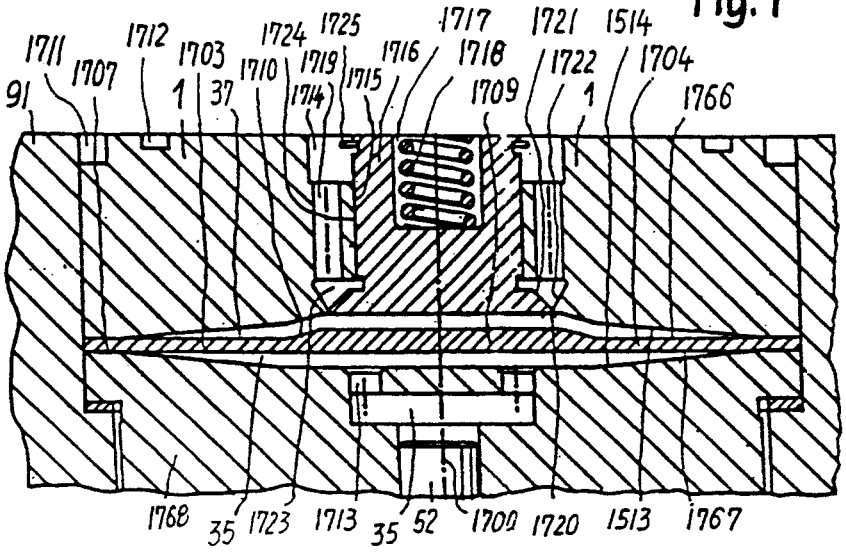
FIG. 1 is a sectional view showing a single membrane and the passage control member in the closed position.

FIG. 1 illustrates the most safe embodiment of the invention for the prevention of disturbance of the membrane under high pressures. At very high pressures the diameters of bores 1706 of the earlier Figures would have to be of such a small diameter, that they may fill with dirt and prevent flow of fluid or that their manufacturing (drilling) becomes too much time consuming and too expensive because too many bores of very small diameter would be required. This problem is overcome by the insertion of the axially stroking flow passage control valve 1716 of the invention. It is in this Figure provided in cover 1 while the outer chamber 35 is bordered by insert 1768 which contains the cylinder, the piston 52 and bore-passages 1713 of collection chamber portion 35. The entire arrangement may be provided in a cylindrical chamber portion of a pump with seal seats 1711, 1712 towards the housing's head cover.

Passage control member 1716 is provided with a cylindrical outer face portion 1724 for axial reciprocal movement along the inner face 1715 of cylindrical and relatively fitting configuration. Spring 1718 in spring seat 1717 presses the flow control member 1716 downwards but the snap ring 1725 is provided to prevent an excessive extend of the stroke of the passage valve 1716. The passage valve 1716 has a front head face and a rear face. With its rear face it touches the upper housing's front face for prevention of excessive upwards movement. The passage valve 1716 is shown in its closing position, which is the uppermost location. The front face aligns with the bordering face 1513 of the inner chamber 37 at this position and location of the control valve, whereby the control valve forms with its front head face a portion of the stroke restricting border face 1513. The front portion of valve 1716 has rearwards an inclined narrowing face and portion 1721 which is radially surrounded by a ring shaped annular space 1723, which space is formed into guide body 1 by the outwardly tapered face and portion 1722. From space 1723 extend substantially axially directed passages 1719 into the end space 1714.

Figure 2:
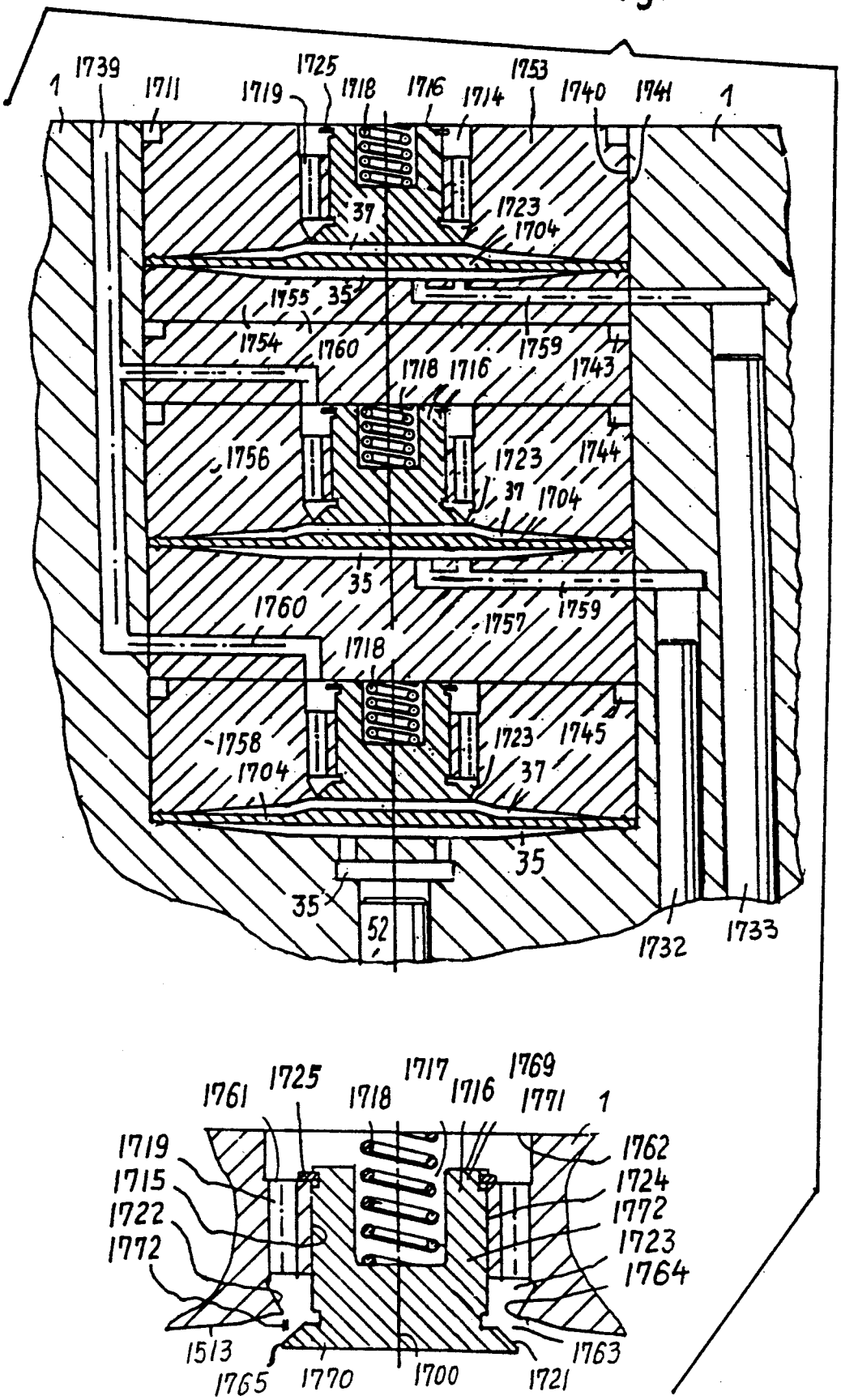
FIG. 2 is a sectional view illustrating a plurality of membranes assembled axially and the control member in the open position.

While in FIG. 1 the important passage control member 1716 is shown in its closed position, the opened location of the passage control valve is seen in the bottom portion of FIG. 2. There the passage valve is moved downward to its downward-most location at which the snap ring 1725 touches the bottom face 1761 of the rear space 1714. This touching prevents any further downwardly directed movement of the passage control valve 1716. It is seen in this Figure portion that the inclined face 1721 has now moved far away from the inclined face 1722 of the guiding body. A relatively wide annular gap 1763 is now opened between the passage control valve 1716 and the guide or cover 1. The fluid can now flow through the wide cross sectioned area of the passages 1763 from the entrance valve into the second or inner chamber 37 and in the opposed direction. When the second or non-lubricating fluid flows through the passage 1763 (at the inlet stroke of the pump) into the inner chamber 37, the membrane moves downwards in its inlet stroke. The passage control valve 1716 follows this movement of the medial portion of the membrane but it is important here, in accordance with the invention, that the stopper means 1725–1761 must be provided in such a style that the axial length of the stroke of the passage control valve 1716 remains shorter than the axial length of stroke of the radially medial portion of the membrane, in order, that the passage valve never meets the membrane. Because if the passage valve would meet the membrane, the membrane may become disturbed.

The passage valve 1716 becomes by its action and function a control valve for the size of the cross sectional area of the passage to the inner chamber (second chamber) 37. In this respect it is important by the present invention, to provide the cylindrical face 1764 on the guide or cover body 1 and to provide the cylindrical outer face 1765 on the front head of the passage control valve 1716. See hereto the bottom portion of FIG. 2. For high pressure the diameters of the faces 1764 and 1765 relative to each other are very important. Between them the radially narrow annular clearance 1772 appears. The radial extent of this clearance 1772 between the faces 1764 and 1765 shall for high pressure be shorter than the axial thickness of the membrane in order that no portion of the membrane can become pressed under high pressure into the annular clearance 1772. Comparing the closed position of the passage valve 1716 in FIG. 1 with its opened position in the bottom portion of FIG. 2, it is easily seen that the passage 1763 has a big cross sectional area in the opened position of FIG. 2 while it has a very small cross sectional area in the closed position of FIG. 1. In the closed position of FIG. 1 the cross sectional area corresponds radially seen to the difference of radii of the faces 1764 and 1765. This radial distance must be so short that it is shorter than the thickness "t" of the co-operating membrane of the pump because otherwise the very high pressure in excess of thousand atmospheres would press a circular portion of the membrane into the clearance 1772 and that would lead to an early break of the membrane. In FIG. 15 the radially medial portion 1709 of membrane 1704 is still axially thickened relative to the radial outer portion of the membrane to prevent disturbance of the membrane at operation of the pump with high pressure. Since in practice it is difficult to treat the surface of a so configurated membrane, in the newer applications of the invention membranes of even thickness throughout the radial extension of the membrane are used. This obtains the invention thereby that the radial clearance 1772 between the faces 1764 and 1765 is made respectively short. For high pressure in excess of one thousand atmospheres the membranes commonly are made of strong metal with a thickness of 0.1 to 0.5 mm and the radial distance of gap 1772 between faces 1764 and 1765 is then 0.08 to 0.4 mm.

Figure 3:
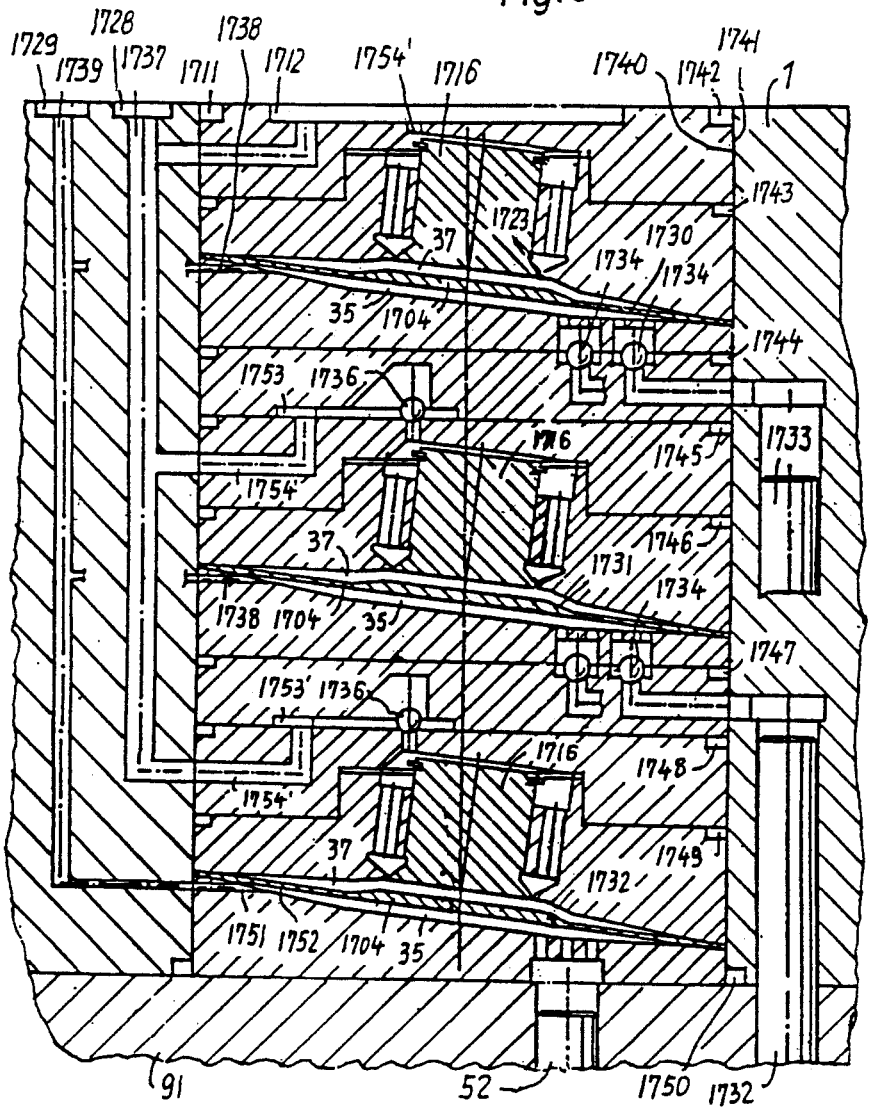
FIG. 3 is a sectional view showing a similar multi-chamber, multi-membrane arrangement of FIG. 2, with the membranes slightly inclined.

FIGS. 2 and 3 illustrate how pumps of small outer dimensions to obtain the aim and object of the invention, may be actually built. In these Figures a plurality of membranes are provided between a plurality of outer and inner (first and second) chambers 35 and 37 axially behind each other. Thereby all membranes of the assembly work—commonly at equal times—to deliver their individual delivery flows into a common delivery flows of fluid of higher delivery quantity.

Thus, in FIG. 2 a plurality of membranes 1704 are assembled axially of each other. The passage control valves 1716 are located in guide bodies 1753, 1756 and 1758 with these guide bodies also forming the stroke restriction faces for the delivery strokes of the membranes. The passages from the outer chambers 35 whereto the piston 52 is (or the pistons 52, 1732, 1733 are) communicated, are shown by passages 1759 through body 1 91 or inserted bodies 1754 and 1757. The several bodies must become sealed relatively against each other and that is accomplished by the provision of seal seats 1711, 1743, 1744, and 1745 whereinto respective plasticly deformable seals or seal rings may be assembled. If the bodies, or some of them, are mounted in a bore in body 1 or 91, the cylindrical outer face 1741 of the respective bodies must have a very close fit on the inner face 1740 of the bore in order to prevent entering of portions of seal ring under the very high pressure into a clearance between cylindrical face 1740 and 1741. Each inner chamber 37 (second chamber 37) is provided with a delivery passage 1760 through a respective guide body, for example, through bodies 1753, 1756 and 1758. The individual delivery passages 1760 combine to the common delivery passage 1739 which leads to the exit valve 39 of the pump or of the respective chamber of the pump.

The herebefore discussed piston 52 may get a respective big diameter or a respective long stroke in order to serve all outer chambers 35 of the multi membrane assembly. But it is also possible to provide a plurality of individual reciprocating pistons 52, 1732, 1733 in respective cylinders to the respective individual first chambers 35. Such individual plural cylinders and pistons with respective passages 1759 to the outer chambers 35 have the feature that the dead space providing passages are then short end of relative small volume. Accordingly piston 1732 and its cylinder extend upwards only until the second outer chamber from the bottom while piston 1733 with its cylinder extends upwards until the top-most outer chamber 35. Piston 52 extends only into the neighborhood of the bottom-most outer chamber 35 in order to obtain short passages 1759 for smaller dead space volume of passages. In big spaces fluid would considerably compress at such high pressures and thereby reduce the efficiency of the pump. The arrangement thereby reduces or prevents excessive dead space and thereby improves the efficiency and reliability of the pump of the invention.

FIG. 3 illustrates a similar multi-chamber and multi-membrane arrangement as FIG. 2. In FIG. 3, however, the membranes are assembled slightly inclined under an angle of inclination. This is done to secure the expulsion of any air in the fluids. Respective air-out passages are set at the highest locations of the respective chambers and such air-out passages 1738, 1751 are seen in this Figure. The air-out passages of the outer chambers 35 may combine to a common air-outflow passage 1739 which may lead to air-out port 1729. Respective closer means or valves of my earlier patent applications and publications may be provided to control the air out flow and close the passages at times when the air is completely out of the chambers. The air outflow from the inner chambers 37 is automatic by the provision of the outlet passages on the highest point of the inner chambers 37. In FIG. 3 are further individual inlet and outlet check valves 1734 and 1736 set to the individual outer and inner chambers 35 and 37. Respective passages and ports 1753' and 1754' may be provided to secure a safe sealing of all bodies and passages relative to each other. Respective inbetween bodies are assembled in FIG. 17 for the setting of valves 1734, 1736 and of passages 1753', 1754', while a respective number of seal seats 1742 to 1750 are then provided to the respective bodies.

What is claimed, is:

1. A membrane in a device wherein two chambers flank said membrane with the first chamber communicated to a cylinder with a therein reciprocable piston, the second chamber communicated to an inlet means and an outlet means, said membrane associated to an annular passage for improvement of the activity of said membrane at its stroke and for the improvement of the life time of said membrane, wherein said second chamber is bordered by a body with a therein axially limitedly movable passage-control valve which narrows and widens by its axially directed stroke the cross-sectional area of said passage to and from said second chamber and which includes at least one portion of said stroke of said valve a narrow circular clearance between said valve and said body with said clearance being smaller than the thickness of said membrane.

2. The device of claim 1, wherein said valve and said body include tapered face portions which form between themselves temporarily a circular chamber portion, wherein passages are provided from said chamber portion to said inlet- and outlet-means of said second chamber, and, wherein cylindrical guide faces are provided on said valve and on said body to direct the axial movement of said valve along the concentric axis of said body.

3. The device of claim 1, wherein stopper means and stopper faces are provided on said valve and on said body which limit the axial movement of said valve to a stroke which is shorter than the stroke of said membrane.

4. The device of claim 1, wherein means are provided to prevent meeting of said valve and said membrane at other locations than the narrowing position of said valve.

5. The device of claim 1, wherein a plurality of membranes, first and second chambers are provided substantially axially of each other and provided with passages to a common collection passage for combined delivery of fluid of said membranes at delivery strokes of said piston(s).

6. The device of claim 5, wherein individual reciprocating pistons are provided to each of said membranes with short passages from the respective cylinders to said first chambers thereby that the respective cylinders and pistons end close to the respective first chambers.

7. A fluid handling device, comprising, in combination, a periodically its volume reducing and increasing, circular, by its outer diameter bordered, fluid handling chamber which on one of its two axial ends is bordered by an axially flexible thin membrane and on the other of its axial ends by a body which forms a cylindrical inner face around a medial hollow space, wherein an axially movable flow control member which has a radial outer face is provided in said hollow space to form a narrow clearance between said radial outer face of said control member and said inner face of said body;

wherein the diameter of said inner face exceeds one fifth of said outer diameter of said fluid handling chamber;

wherein means are provided to prevent excessive axial movement of said control member;

wherein said membrane is a circular sheet of metail, thinner than 0.5 millimeter, and;

wherein said clearance has a radial size which is smaller than three times of the thickness or said membrane.

* * * * *